US005640068A

United States Patent [19]

Amemiya

[11] Patent Number: 5,640,068

[45] Date of Patent: Jun. 17, 1997

[54] SURFACE DISCHARGE PLASMA DISPLAY

[75] Inventor: Kimio Amemiya, Koufu, Japan

[73] Assignee: Pioneer Electronic Corporation, Tokyo, Japan

[21] Appl. No.: 497,797

[22] Filed: Jul. 3, 1995

[30] Foreign Application Priority Data

Jul. 8, 1994 [JP] Japan ..... 6-157596

[51] Int. Cl.[6] ..... H01J 17/49

[52] U.S. Cl. ..... 313/582; 313/584

[58] Field of Search ..... 313/582, 583, 313/584, 585, 586, 491, 492

[56] References Cited

U.S. PATENT DOCUMENTS

| | | | |
|---|---|---|---|
| 4,554,537 | 11/1985 | Dick | 313/491 |
| 4,728,864 | 3/1988 | Dick | 313/582 |
| 5,066,890 | 11/1991 | Salavin et al. | 313/584 |
| 5,420,707 | 5/1995 | Miyazaki | 313/582 |

*Primary Examiner*—Sandra L. O'Shea
*Assistant Examiner*—Mack Haynes
*Attorney, Agent, or Firm*—Sughrue, Mion, Zinn, Macpeak & Seas

[57] ABSTRACT

A surface discharge plasma display apparatus comprising a plurality of pairs of column electrodes extending horizontally in parallel, and a plurality of row electrodes facing the column electrodes at a distance, said row electrodes extending perpendicularly to the column electrodes to define an emitting pixel region with the facing one pair of column electrodes, wherein at least one of the column electrodes in the pair comprises a base portion extending horizontally and a projecting portion extending perpendicularly from the base portion every emitting pixel region, wherein the length of the projecting portion is within the range from 400 μm to 1000 μm. In the surface discharge plasma display apparatus according to the present invention, the emitting efficiency is improved to increase the level thereof, the amount of the current which passes through each of the electrodes may be decreased, thereby the consumption power per emitting pixel region being decreased. Thus, the amount of the heat generated in a unit area of the plasma display apparatus may be decreased, so that the address failure of the emitting pixel region due to the generated heat may be prevented.

5 Claims, 11 Drawing Sheets

SURFACE DISCHARGE PLASMA DISPLAY

FIELD OF THE INVENTION

The present invention relates to a surface discharge plasma display apparatus.

DESCRIPTION OF THE RELATED ART

A surface discharge ac plasma display apparatus is expected to be a large thin color display apparatus.

The surface discharge display apparatus typically includes the three electrode structure. This type of the plasma display comprises two substrates, i.e. a front glass substrate and a back glass substrate which are positioned at a distance in parallel. The inner surface of the front glass substrate as a display surface i.e. the opposite surface to the back glass substrate includes a plurality of pairs of column electrodes. The back glass substrate includes a plurality of row electrodes covered with fluorescent substance. On the side of the display surface, the space including the cross section of one pair of column electrodes and a row electrode in its center defines a unit cell as a pixel.

The larger the size of the display panel in the above plasma display is intended to be realized, the larger the sizes of the column and row electrodes are intended to be.

However, the larger the sizes of the above electrodes are made, the wider the area of the electrodes are. Then, the amount of the current flow supplied to the electrodes is increased proportionally to the electrode area, so that the increase of the consumption power has occurred. Furthermore, due to the increase of the consumption power, the temperature of the plasma display panel is increased. Accordingly, the failure of the addressing to a desired pixel often occurs.

SUMMARY OF THE INVENTION

In order to solve the above problems, a main object of the invention is to provide a surface discharge plasma display apparatus which comprises a large display panel exhibiting a high emitting efficiency and being able to emit a bright light, said apparatus being able to perform a discharge emitting display with a relatively small consumption power.

A surface discharge plasma display apparatus according to the present invention comprises a plurality of pairs of column electrodes extending horizontally in parallel, and a plurality of row electrodes facing to the column electrodes at a distance, said row electrodes extending perpendicularly to the column electrodes to define an emitting pixel region, wherein at least one of column electrodes per pair comprises a base portion extending horizontally and a projecting portion extending from the base portion every emitting pixel region, and wherein the length of the projecting portion is within the range from 400 μm to 1000 μm.

A surface discharge plasma display apparatus according to the present invention comprises a plurality of pairs of column electrodes extending horizontally in parallel, and a plurality of row electrodes facing the column electrodes at a distance, said row electrodes extending perpendicularly to the column electrodes to define an emitting pixel region, wherein at least one of the column electrodes per pair comprises a base portion extending horizontally and a projecting portion extending perpendicularly from the base portion every emitting pixel region, and wherein the projecting portion includes a narrow portion in which the horizontal width is narrower than that of the top in an area except the top.

In the surface discharge plasma display apparatus according to the present invention, the emitting efficiency is improved to increase the level thereof, while at least one of the amount of discharge current flow and the discharge starting voltage may be decreased, then the consumption power may be decreased.

In the surface discharge plasma display apparatus according to the present invention, the emitting efficiency is improved to increase the level thereof, the amount of the current which passes through each of the electrodes is decreased, so that the consumption power per emitting pixel region may be decreased. Thus, the amount of the heat generated in an unit area of the plasma display panel is decreased, so that the failure of addressing a desired emitting pixel region due to the generated heat may be prevented.

BRIEF EXPLANATION OF THE DRAWINGS

The above set forth and other features of the invention are made more apparent in the ensuring detailed description of the invention when read in conjunction with the attached drawings, wherein.

Although embodiments of a plasma display apparatus according to the present invention will be described hereinbelow, the present invention is not limited to the embodiments disclosed but is limited by only the scope of the appended claims of the present invention.

DETAILED DESCRIPTION OF THE PREFERRED EMBODIMENTS

An embodiment of a plasma display apparatus according to the present invention will be described hereinbelow with reference to FIGS. 1–4.

Figure 1:
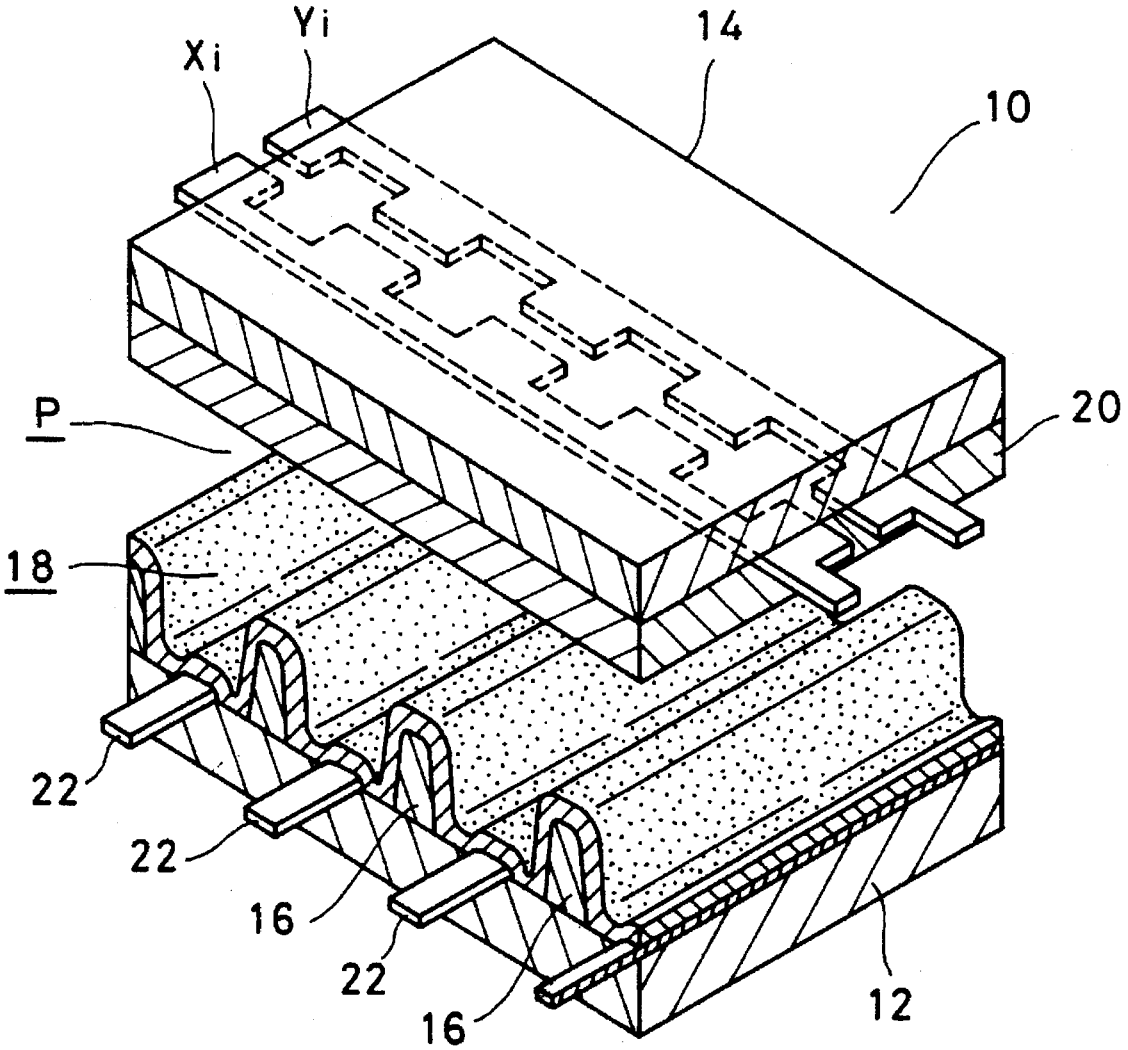
FIG. 1 is a perspective view showing the structure of a unit cell in a plasma display apparatus according to the present invention.

Referring to FIG. 1, reference numeral 10 denotes a unit cell of a surface discharge ac plasma display device taking three electrodes configuration. The unit cell 10 comprises a back substrate 12, a surface substrate of a transparent glass positioned in parallel to the back substrate at intervals of 100–200 μm, barrier ribs 16 formed on the back substrate 12 to hold the gap between the surface substrate 14 and the back substrate 12. Each of the spaces surrounded with the surface substrate 14, the back substrate 12 and the adjacent barrier ribs 16, 16 defines a discharge space 18.

The surface substrate 14 is a display surface in the plasma display apparatus. On the opposite surface of the surface substrate 14 to the back substrate 12, a plurality of pairs of column electrodes Xi, Yi (i=1, 2, . . . n) having the thickness of several hundred nm are formed extending horizontally in parallel to each other by depositing such a metal as ITO and tin oxide (SnO) thereon. These pairs of column electrodes serve as sustain electrodes. Furthermore, a dielectric layer 20 having the thickness of substantially 10 μm is formed covering over these pairs of column electrodes. On the dielectric layer 20, a magnesium oxide layer (not shown) is deposited.

A plurality of the barrier ribs 16 are preferably formed extending in parallel to each other at intervals of 380 μm on the back substrate 12 by utilizing the method for a thick-film printing, then the barrier ribs extend perpendicularly to the pairs of column electrodes Xi, Yi. It is noted that the distance between the adjacent barrier ribs is limited to only 380 μm, but may be changed into suitable value based on the size of the plasma display panel as the display surface and/or the numbers of the unit cells.

A row electrode 22 which serves as an address electrode is formed perpendicularly on the back substrate 12 between the adjacent barrier ribs.

The row electrode 22 is preferably made of aluminum (Al) or aluminum alloy. The row electrode 22 having the thickness of substantially 100 nm extends perpendicularly on the back substrate 12, facing to the pair of column electrodes Xi, Yi. The row electrode 22 is made of the metal having such higher reflectance as that of Al or Al-alloy, so that the electrode 22 has the reflectance of more than 80% within the wavelength range of 380–650 nm.

It is noted that the row electrode 22 is made of not only Al and Al-alloy, but also of appropriate metal and alloy such as Cu and Au having higher reflectance.

Accordingly, In the discharge region 18, an emitting pixel region P is defined to include the crossing of the pair of column electrodes Xi, Yi and the row electrode 22 in the center thereof.

The surface substrate 14 and the back substrate 12 having formed with the column electrodes and the row electrodes then are sealed together. The air in the discharge region 18 is exhausted, and the water on the surface of the MgO layer is vapored away by baking the whole of the sealed substrates. Inertia composite gas including xenon (Xe) gas at 1–10%, for example, as a rare gas are introduced and sealed into the discharge region 18 in the manner that the pressure of the inertia gas is 200–600 torr.

If the above plasma display apparatus provides a color display, an emitting layer consisting of three types of fluorescent films is formed cover each of the row electrodes on the back substrate 12, in which each of films corresponds to one of three primary colors R, G and B in turn from the upper toward the bottom.

Described above, the unit cell 10 which is capable of emitting a light is provided. In each of the discharge region 18, by the pulse voltages applied to each of the three electrodes i.e. the column electrodes Xi and Yi and the row electrode 22, the starting, sustaining and extinguishing discharge of the unit cell including the emitting pixel region P at the center are controlled.

The shape and the size of the column electrodes Xi, Yi are described.

Figure 2:
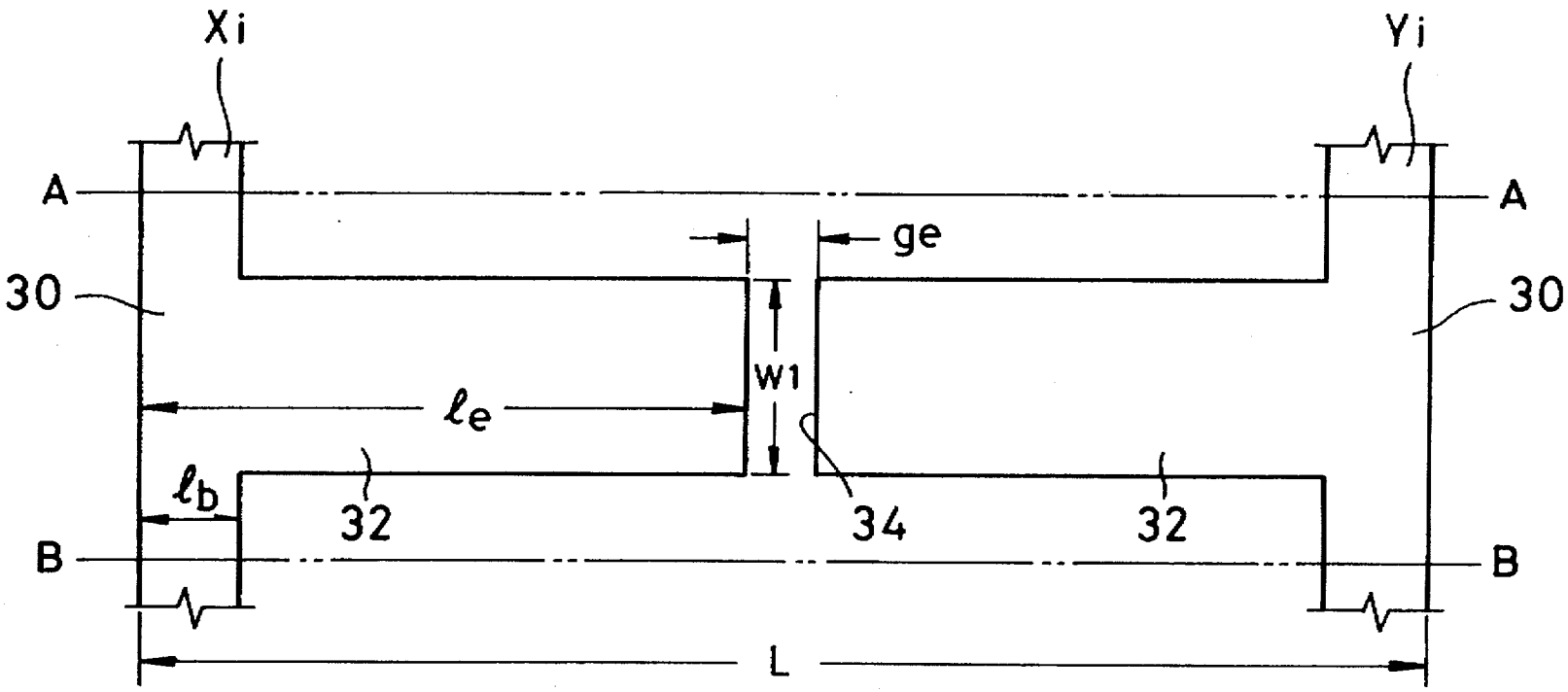
FIG. 2 is a plan showing a pair of column electrodes according to the present invention.

FIG. 2 illustrates a plan of the column electrodes Xi and Yi. Referring to FIG. 2, one of the column electrodes Xi consists of a base portion 30 extending horizontally in each of the emitting pixel regions, and a projecting portion extending cross the longitudinal direction of the base portion 30 toward the other column electrode Yi. The other of the column electrodes Yi similarly consists of a base portion extending horizontally in each of the emitting pixel regions, and a projecting portion extending cross the longitudinal direction of the base portion toward the other electrode Xi. Accordingly, both of the projecting portions 32, 32 of the column electrodes Xi and Yi are opposite to each other through a predetermined gap ge. The projecting portion 32 preferably extends perpendicularly to the longitudinal direction of the base portion 30.

The sizes of each of the portions in the column electrodes Xi and Yi are indicated below. The longitudinal length of the base portion 30 per one discharge region (the distance between lines A—A and B—B in FIG. 2) corresponds to the interval between the adjacent barrier ribs, and equals to 380 μm. As seen in FIG. 2, the table 1 indicates the length of the projecting portion 32 i.e. the sum of the width of the base portion 30 and the longitudinal length of the projecting portion 32 le, and the width w1 of the top of the projecting portion.

TABLE 1

| | length (μm) |
|---|---|
| le | 400–1000 |
| w1 | 200–250 |

In preferable embodiments, the sizes of le and w1 are 700 μm and 200 μm, respectively.

If le and w1 take the above value in the table 1, in preferable embodiments, the perpendicular length L of the emitting pixel region equals to 1300 μm, the gap ge between the column electrodes Xi and Yi equals to 70 μm, the width 1b of the base portion 30 equals to 100 μm.

Figure 3:
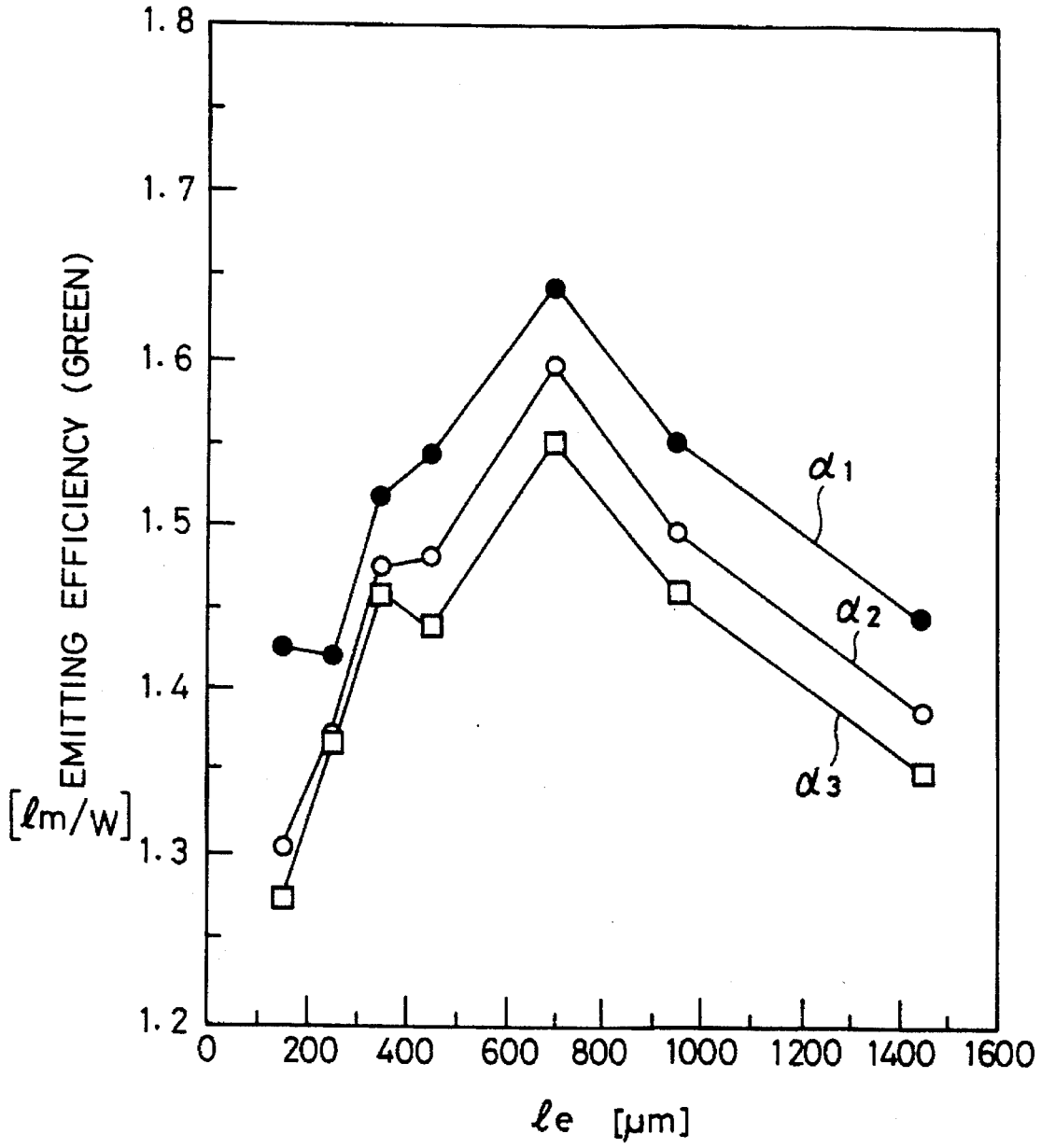
FIG. 3 is a diagram showing the relationship between the length le of the projecting portion and the emitting efficiency.

FIG. 3 illustrates the emitting efficiency in case of the unit cell 10 emitting a green light by utilizing the pair of column electrodes Xi and Yi described above. FIG. 3 indicates a diagram illustrating the relation between the length le of the projecting portion 32 whose width of the top 34 equals to 200 μm and the emitting efficiency of the unit cell 10 depending on each of the voltage applied to the unit cell 10, 180 V, 190 V and 200 V. In FIG. 3, the curves $\alpha_1$, $\alpha_2$ and $\alpha_3$ correspond to the cases in which the levels of the voltages applied to each of the unit cell 10 are 180 V, 190 V and 200 V, respectively. Seen from FIG. 3, within the range of 200–700 μm of the length le of the projecting portion 32, the longer le is, the more the emitting efficiency increases independently of the levels of the applied voltages. When the le equals to 700 μm, the emitting efficiency takes the largest value. Then, the le takes the more value than 700 μm, the emitting efficiency decreases gradually. As a result, in order to obtain the largest emitting efficiency, it is preferable that le equals to 700 μm.

Figure 4:
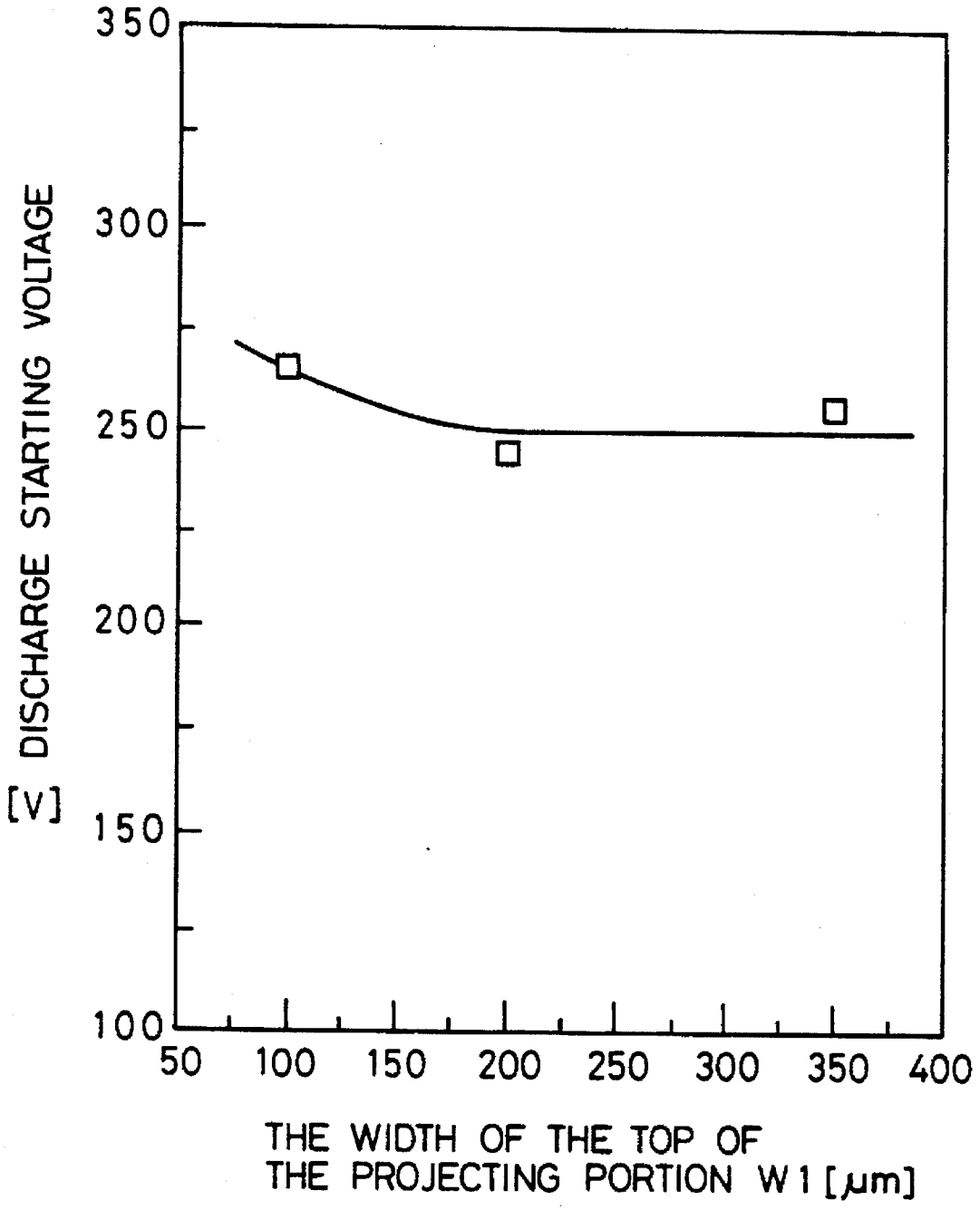
FIG. 4 is a diagram showing the relationship between the width w1 of the top and the discharge starting voltage.

Next, referring to FIG. 4, in case of using the above pair of column electrodes Xi and Yi, FIG. 4 illustrates the relation between the width w1 of the top 34 of the projecting portion 32 in the column electrode and the discharge starting voltage of the unit cell 10. FIG. 4 also illustrates the variation of the discharge starting voltage as a function of the value of w1 when the projecting portion takes the constant length le. The wider the w1 is, the more the discharge starting voltage decreases. When the w1 takes the larger value than 200 μm, the discharge starting voltage keeps constant. Therefore, it is preferable that the w1 corresponding to the smallest discharge starting voltage of the unit cell 10 equals to more than 200 μm.

Accordingly, when the pair of column electrodes Xi and Yi is formed with the following sizes; the length le of the projecting portion equals to 700 μm, and the horizontal width w1 of the top 34 of the projecting portion 32 equals to 200 μm, the emitting efficiency of the unit cell 10 takes the largest value and the discharge starting voltage takes the smallest value. In other words, the emitting efficiency is hold the largest level, while, the discharge starting voltage is decreased, so that the consumed power by the plasma display apparatus is able to hold the lower level.

In the preferable embodiments, the width 1b of the base portion 30 in the column electrodes Xi and Yi equals to 100 μm. However, in the present invention, it is noted that the width is not limited to the above value. In the apparatus according to the present invention, it is preferable that the width of the base portion 30 takes a suitable value within the range of 50–200 μm, so that the similar advantages to the above embodiments are obtained.

Figure 5:
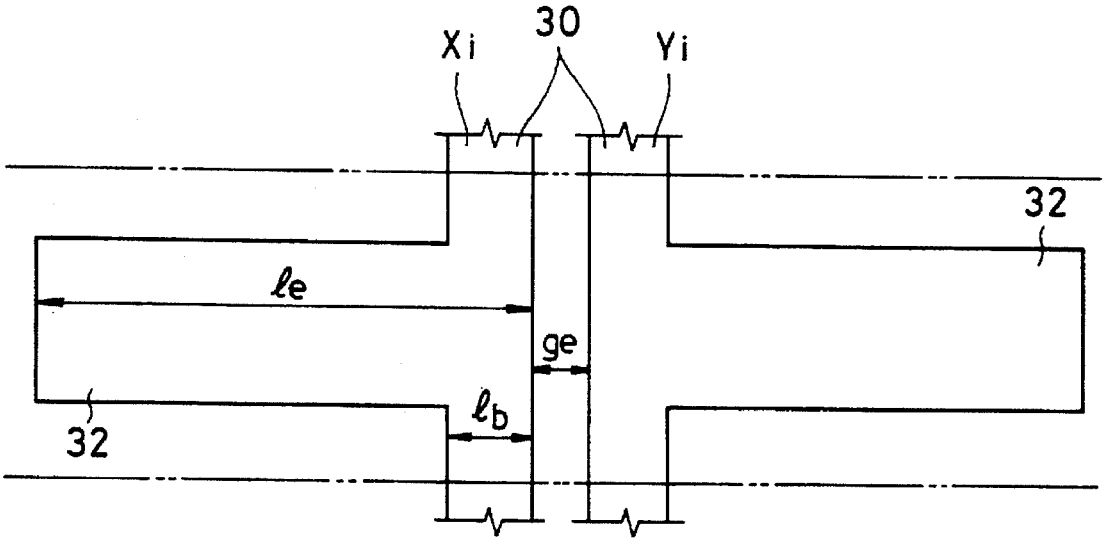
FIG. 5 is a plan showing a pair of column electrodes which have the different constitution from that of the column electrodes of FIG. 2.

In one unit cell of the above embodiment, both of the column electrodes Xi, Yi have the projecting portion 32 extending from the base portion 30 in the manner that each top 34 of the projecting portion 32 of the column electrodes Xi, Yi faces to each other. In another embodiment shown in FIG. 5, the column electrodes Xi, Yi may be positioned in the manner that the projecting portion 32 of one of the column electrodes extends from the base portion 30 in the opposite direction to the other column electrode, and the projecting portion of the other column electrode similarly extends in the opposite direction of the one of column electrode, so that it is expected that the similar advantages to the prior embodiment are obtained. In this case, the gap between the column electrodes corresponds to the gap ge between the base portions.

Figure 6:
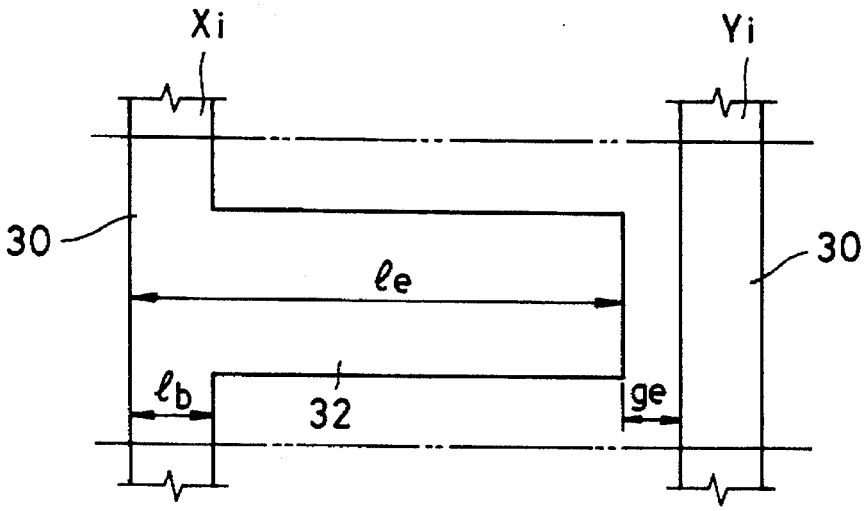
FIG. 6 is a plan showing a pair of column electrodes which have the different constitution from those of the column electrodes of FIGS. 2 and 5.

In further embodiment shown in FIG. 6, the column electrodes Xi, Yi are formed in the manner that one of the column electrodes may have a base portion 30 with a projecting portion 30, while the other column electrode may have only a base portion 30 without a projecting portion. In this case, it is preferable that the gap ge between the column electrodes Xi, Yi equals to 70 μm and that the width 1b of the base portion 30 equals to 100 μm. In the configuration shown in FIGS. 5 and 6, the similar advantages to those of the first embodiment such as the relationship between the le and the emitting efficiency and the relationship between the w1 and the discharge starting voltage are obtained, so that the emitting efficiency may take the highest level as the le equals to 700 μm, and the discharge starting voltage takes the smallest value as the w1 equals to 200 μm. Accordingly, when the column electrode Xi is formed with the length le of the projecting portion 32 being 700 μm, and the horizontally length w1 of the top 34 of the projecting portion 34 being 200 μm, the emitting efficiency takes the largest level, while the level of the discharge starting voltage is decreased, then the consumption power in the plasma display apparatus may be restrained.

The second embodiment according to the present invention is described in conjunction with FIGS. 7A–9. In this embodiment, the constitutional elements of the unit cell 10 is similar to those of the prior embodiment except that the shape of the column electrode Xi, Yi is different from that of the prior embodiment.

Figure 7A:
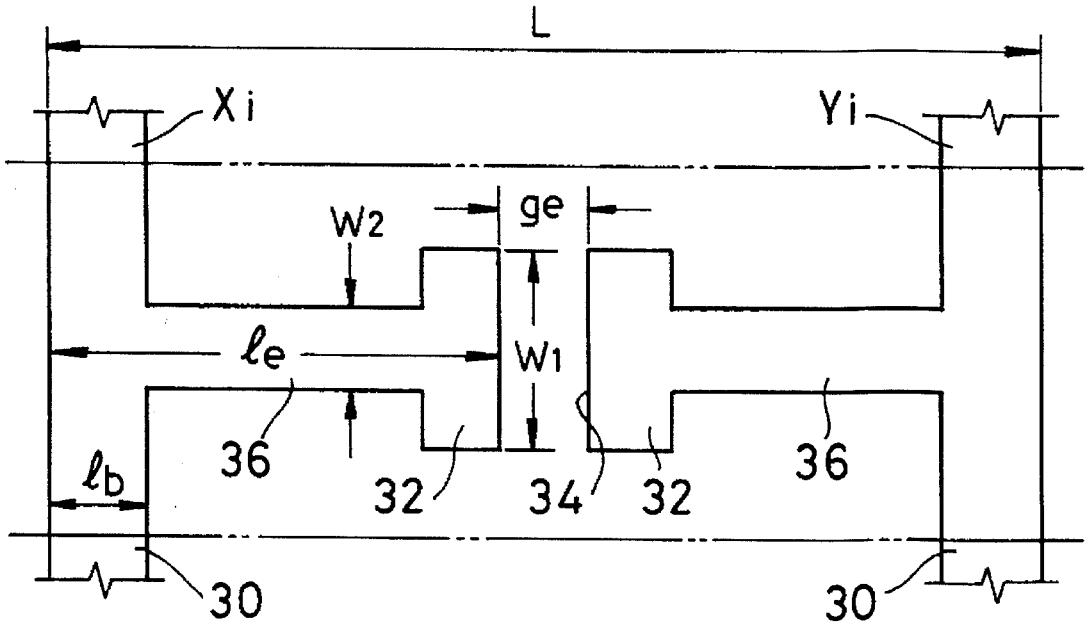
FIG. 7A is a plan showing a pair of column electrodes in the second embodiment.

FIG. 7A shows a plan of a pair of column electrodes Xi, Yi. One of the column electrodes Xi consists of a base portion 30 extending horizontally and a projecting portion 32 extending from the base portion 30 toward the other column electrode Yi substantially perpendicularly to the longitudinal direction of the base portion 30. Similarly, the other column electrode Yi consists of a base portion 30 extending horizontally and a projecting portion 32 extending from the base portion 30 toward the projecting portion 32 of the column electrode Xi substantially perpendicularly to the longitudinal direction of the base portion 30. Accordingly, both of the projecting portions 34, 34 of the column electrodes Xi and Yi extend in the opposite direction respectively, so that the tops of the projecting portions is faced to each other through a predetermined gap ge. It is noticed that the projecting portion 32 preferably extends perpendicularly to the longitudinal direction of the base portion 30.

Each of the projecting portions 32 of the column electrodes Xi, Yi has a narrow portion 36 within an area except the top 34, as shown in FIG. 7A. In the narrow portion 36, its width w2 is formed narrower than the horizontally width w1 of the top 34. The size of each portion is described as following. Referring to FIG. 7A, the gap between the barrier ribs equals to 380 μm, the width L of the column electrodes Xi, Yi equals to 1030 μm, the width 1b of the base portion 30 equals to 100 μm, the length le of the projecting portion equals to 470 μm, the width w1 of the top 34 in the projecting portion 32 equals to 200 μm, and the gap ge between the facing tops of both of the column electrodes Xi, Yi equals to 90 μm. The narrow portion 36 starts at the point which is apart away from the top 34 of the projecting portion 32 by 80 μm toward the base portion 30, and ends at the connecting portion with the base portion 30. The width w2 of the narrow portion 36 equals to 80 μm.

Figure 7B:
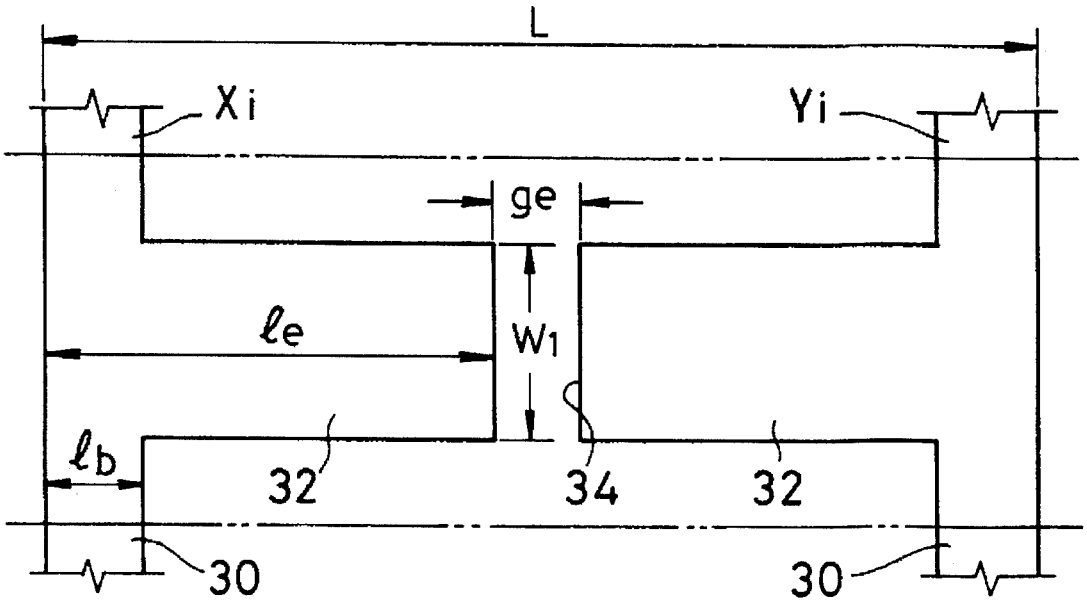
FIG. 7B is a plan showing the similar column electrodes to that of the first embodiment.
Figure 8:
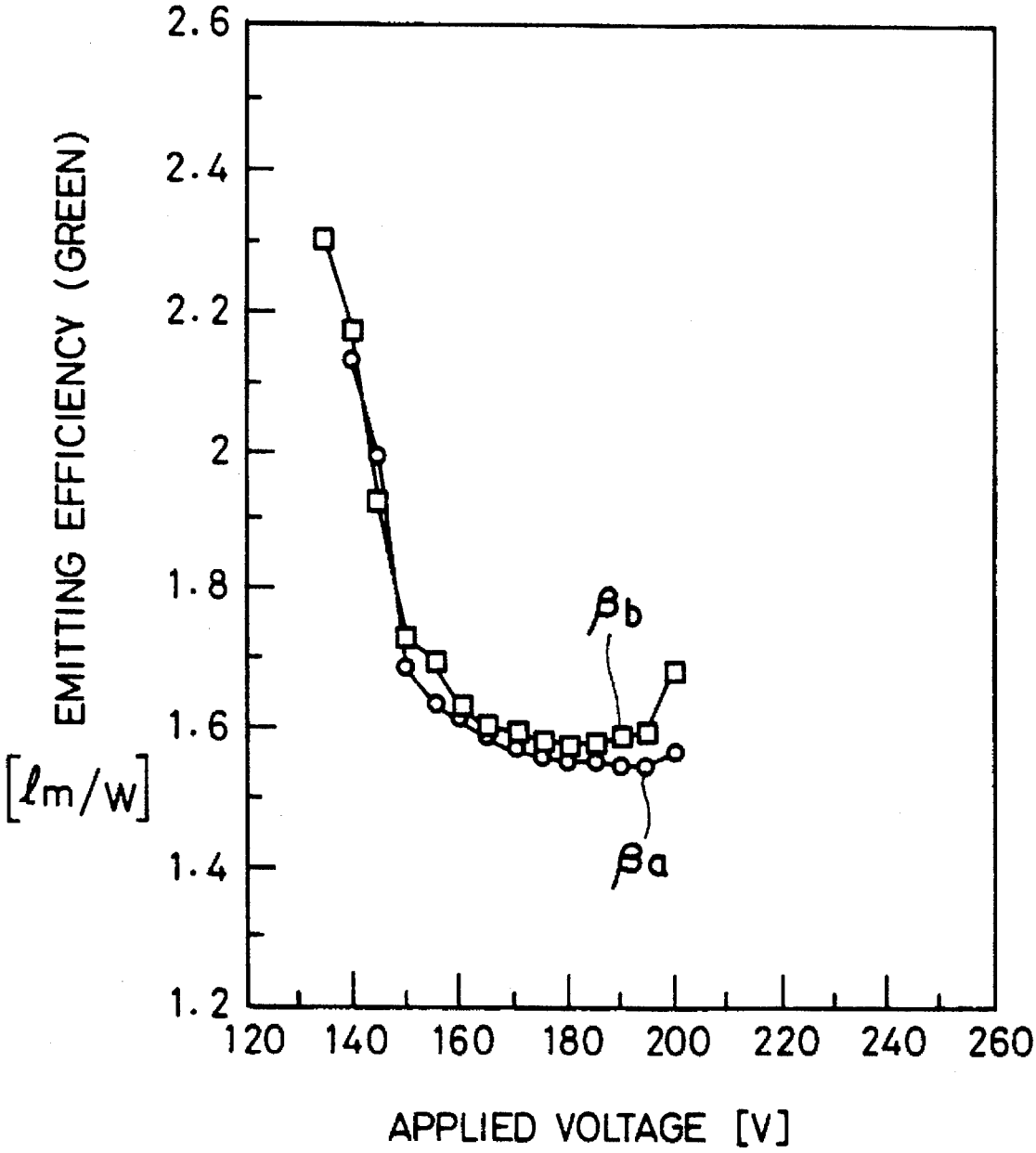
FIG. 8 is a diagram showing the relationship between the applied voltage to each of the column electrode and the emitting efficiency.

FIG. 8 illustrates the variation of the emitting efficiency of the pixel 10 having the column electrodes Xi, Yi with the narrow portion 36. For a purpose of the comparison, FIG. 8 also shows the variation of the emitting efficiency of the pixel 10 including the column electrodes Xi, Yi having no narrow portion 36 as shown in FIG. 7B. FIG. 8 shows the variation of the green emitting efficiency when the level of the voltage applied to the column electrodes Xi, Yi changes, the curve βa illustrates the variation of the emitting efficiency of the pixel 10 including the column electrodes Xi, Yi with the narrow portion 36, and the curve βb illustrates the variation of the emitting efficiency including the column electrodes Xi, Yi with no narrow portion 36. For both of the shapes of the column electrodes, the emitting efficiency decreases drastically until the applied voltage reaches 150 V. However, when the applied voltage exceeds 150 V, the emitting efficiency maintains constant. Furthermore, the emitting efficiency holds the same level without regard to the presence or absence of the narrow portion 36.

Figure 9:
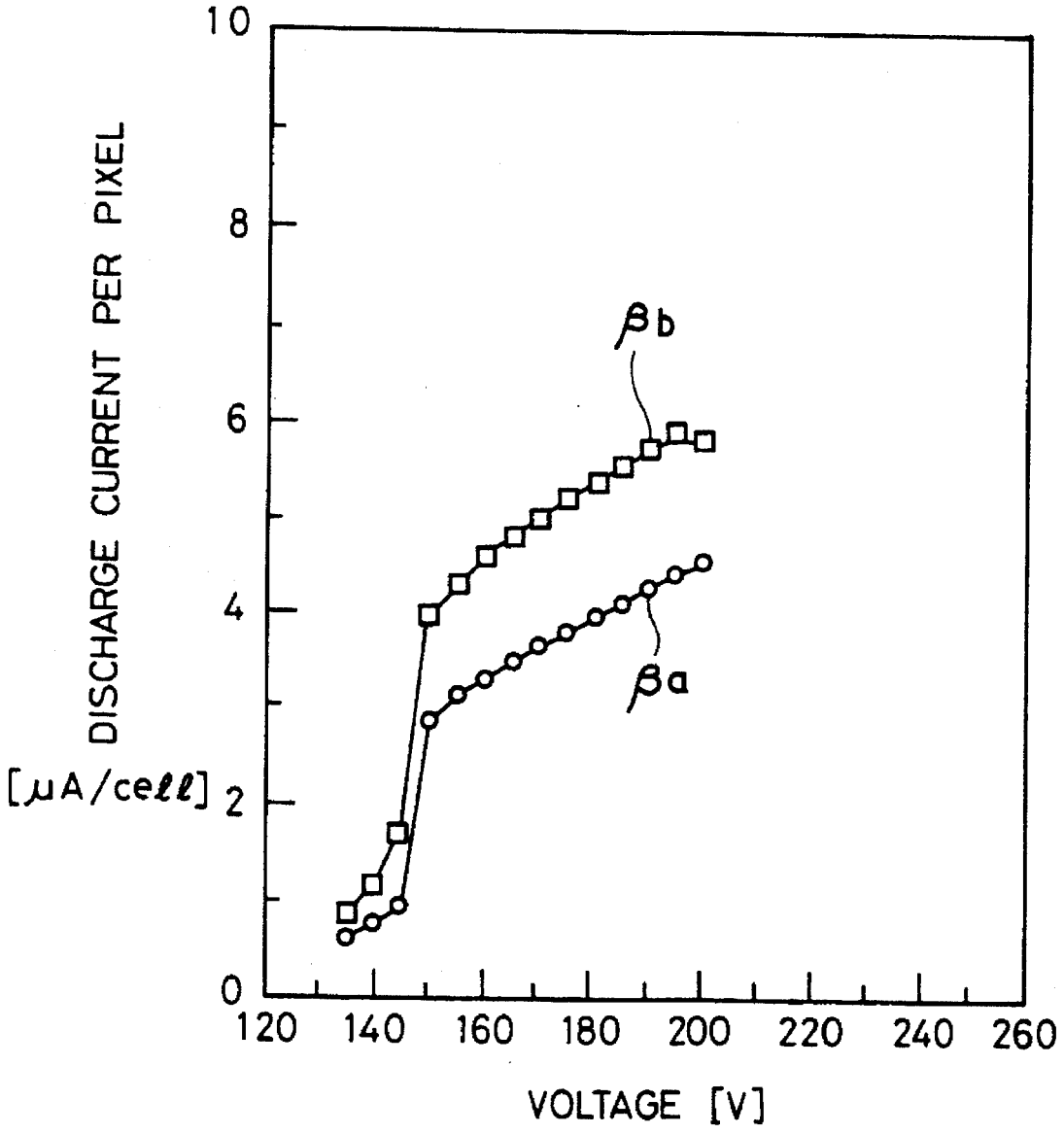
FIG. 9 is a diagram showing the relationship between the applied voltage to each of the column electrodes and the discharge current flow per unit cell.

FIG. 9 illustrates the relationship between the applied voltage and the discharge current per unit cell in the pixel 10 having the column electrodes Xi, Yi with the narrow portion 36. For a purpose of the comparison, FIG. 9 also shows the relationship between the applied voltage and the discharge current in the pixel 10 having the column electrodes Xi, Yi with no narrow portion shown in FIG. 7B. In FIG. 9, the curve βa indicates the variation of the discharge current in the case of utilizing the column electrode with the narrow portion 36, and the curve βb indicates the variation of the discharge current in the case of utilizing the column electrodes with no narrow portion 36. The more the applied voltage increases, the more the amount of the current supplied to the pixel 10 increases. In any cases, comparing the discharge current of the pixel 10 including the narrow portion 36 with that of the pixel 10 having no narrow portion 36, it is understood that the discharge current of the pixel 10 including the narrow portion 36 is always lower than that of the pixel 10 having no narrow portion 36. The column electrodes Xi, Yi with the narrow portion 36 have the smaller electrode area than that of the column electrodes with no narrow portion 36, so that the amount of the current flow passing through the electrodes is less than those of the column electrodes without the narrow portion 36.

Accordingly, as seen from FIGS. 8 and 9, comparing with the pixel 10 including column electrodes with no narrow portion 36, it is clear that the narrow portion 36 in the projecting portion 32 makes the amount of the discharge current flow decreased, the consumption power is decreased while the emitting efficiency is maintained constant. As a result, the amount of the thermal energy generated in the pixel 10 may be limited to the lower level.

Thus, at least one of the column electrodes Xi, Yi is provided with the base portion 30 extending horizontally and the projecting portion 32 extending from the base portion 30 toward the other column electrode, furthermore, in the area except the top 34 of the projecting portion 32, the narrow portion which has the narrower width than the horizontal width of the top 34. Therefore, the emitting efficiency of the pixel including the column electrodes with the narrow portion takes the similar level to that of column electrodes including the column electrodes with no narrow portion, while the amount of the discharge current flow in the pixel with the narrow portion is decreased, so that the consumption power per a pixel may be decreased.

It is noted that the shape and the sizes of the narrow portion 36 is not limited to the configuration shown in FIG. 7A.

Referring to the above description, it is understood that the emitting efficiency is depended on both of the longitudinal perpendicular length of the projecting portion 32 which includes the perpendicular length of the base portion 30 in the projecting portion 32 and the horizontal width of the top 34 of the projecting portion 32. In the case that the projecting portion 32 has the longitudinal length le and the horizontal width w1 decided in the above manner, the narrow portion 36 preferably includes only a region which has the narrower width than the horizontal width of the top in the area except the top of the projecting portion. Due to the presence of the narrow portion, the amount of the discharge current flow per unit cell is decreased. Accordingly, the similar advantages to those of the second embodiment appear in the apparatus taking the configuration shown in FIGS. 10A–12B.

Figure 10A:
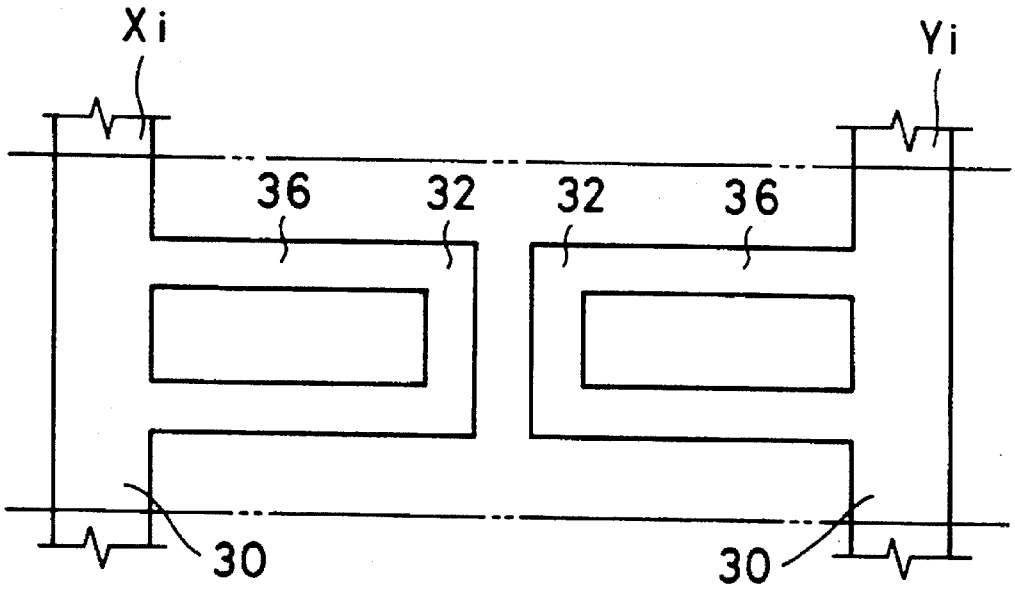
FIG. 10A is a plan showing another configuration of the column electrodes.
Figure 10B:
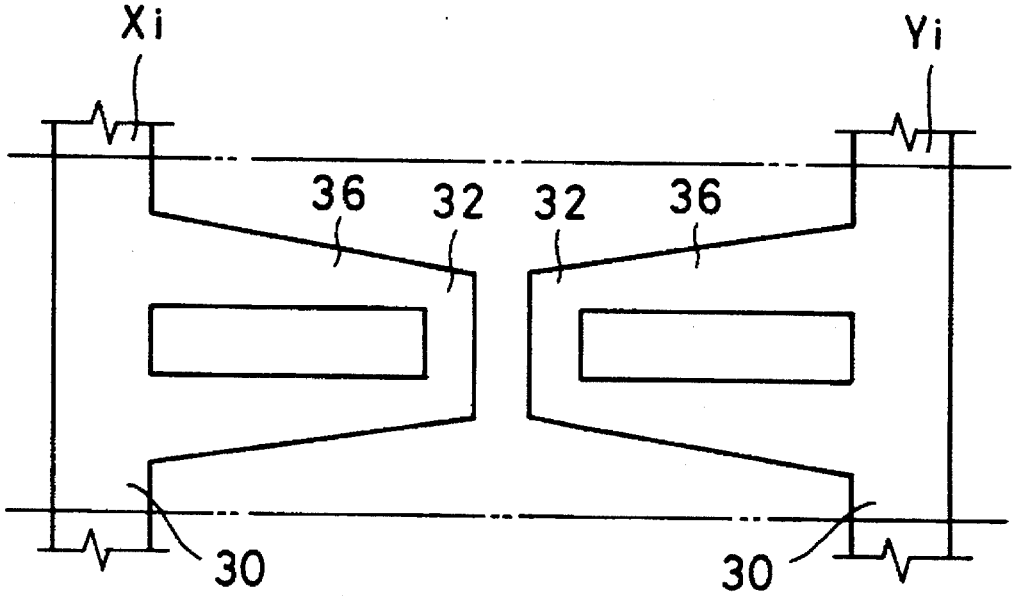
FIG. 10B is a plan showing still another configuration of the column electrodes.
Figure 11A:
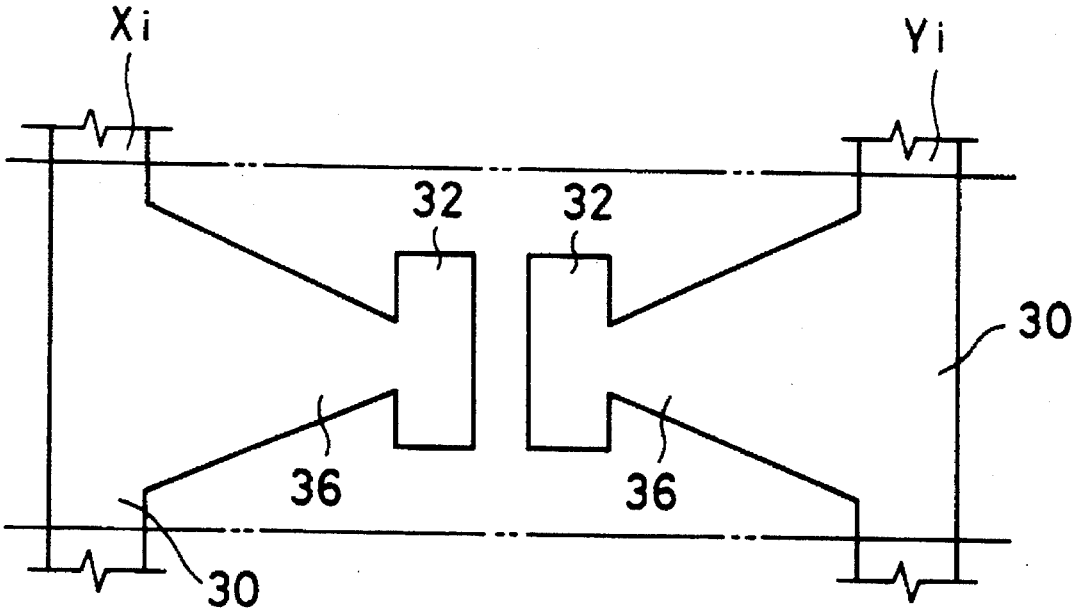
FIG. 11A is a plan showing further configuration of the column electrodes.
Figure 11B:
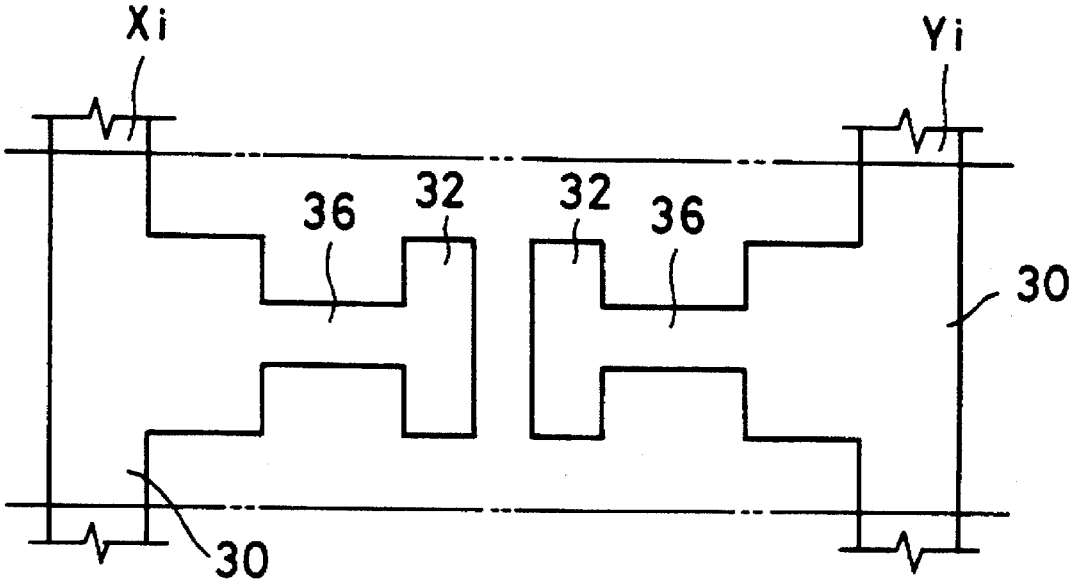
FIG. 11B is a plan showing yet still another configuration of the column electrodes.

In FIG. 10A, a narrow portion 36 lacks a longitudinal area corresponding to the internal region of the projecting portion 32. A projecting portion 32 in FIG. 10B has the horizontal width which is decreased gradually toward the top, and the narrow portion 36 lacks a longitudinal area corresponding to the internal region of the projecting portion 32. In FIG. 11A, a projecting portion 32 includes a square area near the top 34, the narrow portion 36 has the narrower width than that of the top 34 at the terminating point of the square area, and the horizontal width of the narrow portion 36 extends gradually toward the base portion 30. A projecting portion 36 in FIG. 11B has a narrow portion 36 in only one region along the longitudinal direction.

Figure 12A:
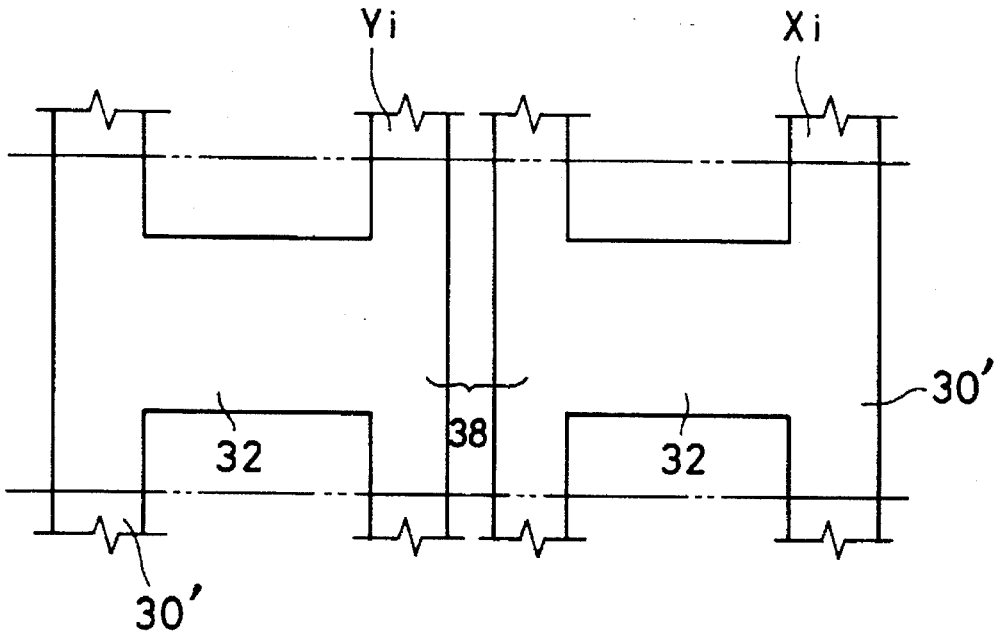
FIG. 12A is a plan showing another configuration of the column electrodes.
Figure 12B:
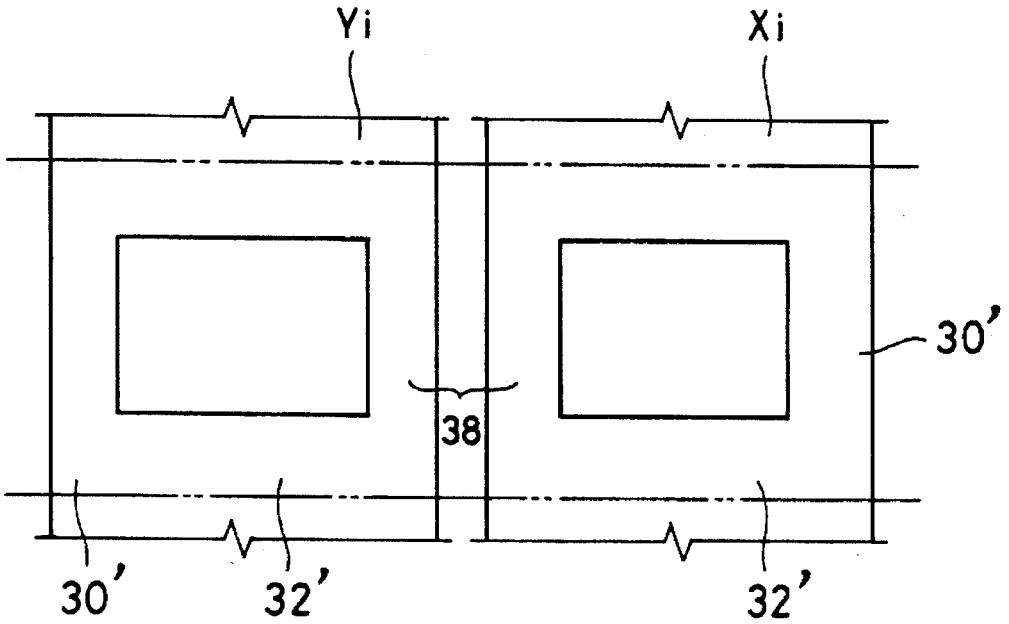
FIG. 12B is a plan showing still another configuration of the column electrodes.

In FIG. 12A, each of a pair of column electrodes Xi, Yi includes, in an emitting unit cell, a base portion 30' extending horizontally, a projecting portion 32' extending from the base portion 30' toward another column electrode and an opposite extending portion 38 connected to the top of the projecting portion 32' to extend horizontally. The opposite extending portion 38 is connected with the adjacent opposite extending portion in the horizontally adjacent emitting pixel. In FIG. 12B, each of a pair of column electrodes Xi, Yi includes similarly, in an emitting unit cell, a base portion 30' extending horizontally, two projecting portion 32' extending from the base portion 30' toward another column electrode, and an opposite extending portion 38 connected to the top of the projecting portion 32' to extend horizontally. In addition, each of the projecting portion 32' is connected to the adjacent projecting portion of the horizontal adjacent emitting unit cell.

It is understood that the foregoing description and accompanying drawings set forth the preferred embodiments of the invention at the present time. Various modifications, additions and alternative designs will, of course, become apparent to those skilled in the art in light of the foregoing teachings without departing from the spirit and scope of the disclosed invention. Thus, it should be appreciated that the invention is not limited to the disclosed embodiments but may be practiced within the full scope of the appended claims.

What is claimed is:

1. A surface discharge plasma display apparatus comprising a plurality of pairs of column electrodes extending in a horizontal direction in parallel, and a plurality of row electrodes facing the column electrodes at a distance therefrom, said row electrodes extending perpendicularly with respect to said column electrodes to define emitting pixel regions with the pairs of column electrodes wherein at least one of the column electrodes in at least one of the pairs comprises:

a base portion extending straightly in a continuous manner along said horizontal direction; and a projecting portion projecting from the base portion perpendicularly at every emitting pixel region wherein the length of said projecting portion has a value within a range from 400 μm to 1000 μm, and wherein said projecting portion includes a narrow portion provided adjacent the base portion and a wide portion which has a wider horizontal width than that of the narrow portion, and wherein said wide portion faces the other of the column electrodes in the at least one of the pairs by a predetermined gap.

2. A surface discharge plasma display apparatus comprising a plurality of pairs of column electrodes extending in a horizontal direction in parallel, and a plurality of row electrodes facing the column electrodes at a distance therefrom, said row electrodes extending perpendicularly with respect to said column electrodes to define emitting pixel regions with the pairs of column electrodes wherein each of the column electrodes in at least one of the pairs comprises:

a base portion extending straightly in a continuous manner along said horizontal direction; and a projecting portion projecting from the base portion perpendicularly at every emitting pixel region wherein the length of said projecting portion has a value within the range from 400 μm to 1000 μm, in which the projecting portion of one of the column electrodes extends in the opposite direction to the other column electrode in the at least one of the pairs.

3. A surface discharge plasma display apparatus comprising a plurality of pairs of column electrodes extending in a horizontal direction in parallel, and a plurality of row electrodes facing the column electrodes at a distance therefrom, said row electrodes extending perpendicularly with respect to the column electrodes to define emitting pixel regions with the pairs of column electrodes wherein at least one of the column electrodes in at least one of the pairs comprises:

a base portion extending straightly in a continuous manner along said horizontal direction; and a projecting portion projecting from the base portion perpendicularly at every emitting pixel region, said projecting portion including a narrow portion provided adjacent the base portion and a wide portion which has a wider horizontal width than that of the narrow portion, wherein said wide portion faces the other of the column electrodes in the at least one of the pairs by predetermined gap.

4. The surface discharge plasma display apparatus according to claim 3, wherein the horizontal width of the wide portion of said projecting portion has a value within the range from 200 μm to 250 μm.

5. The surface discharge plasma display apparatus as claimed in claim 3, wherein the length of each of said emitting pixel regions in the direction of the row electrodes is 1300 μm, and the length of each of said projecting portions is such that a gap between an edge of each of the projecting portions and the other column electrode in the pair is 70 μm.

* * * * *